US009116507B2

(12) United States Patent
Vuilleumier et al.

(10) Patent No.: US 9,116,507 B2
(45) Date of Patent: Aug. 25, 2015

(54) UNIVERSAL TIMEPIECE

(75) Inventors: Alain Vuilleumier, La Chaux-de-Fonds (CH); Jean-Jacques Born, Morges (CH); Dominique Lechot, L'Orient (CH)

(73) Assignee: The Swatch Group Research and Development Ltd., Marin (CH)

( * ) Notice: Subject to any disclaimer, the term of this patent is extended or adjusted under 35 U.S.C. 154(b) by 0 days.

(21) Appl. No.: 14/004,602

(22) PCT Filed: Mar. 15, 2012

(86) PCT No.: PCT/EP2012/054590

§ 371 (c)(1),
(2), (4) Date: Sep. 11, 2013

(87) PCT Pub. No.: WO2012/123550

PCT Pub. Date: Sep. 20, 2012

(65) Prior Publication Data

US 2014/0003198 A1 Jan. 2, 2014

(30) Foreign Application Priority Data

Mar. 15, 2011 (EP) ..... 11158321

(51) Int. Cl.
*G04B 19/22* (2006.01)

(52) U.S. Cl.
CPC ..... *G04B 19/22* (2013.01); *G04B 19/223* (2013.01)

(58) Field of Classification Search
CPC ..... G04B 19/22; G04B 19/207; G04B 19/223
USPC ..... 368/21–22, 27, 220–222, 231–237
See application file for complete search history.

(56) References Cited

U.S. PATENT DOCUMENTS

| | | | | |
|---|---|---|---|---|
| 369,462 | A * | 9/1887 | Moyer | 368/27 |
| 927,472 | A * | 7/1909 | Aufiero | 368/27 |
| 2,148,907 | A * | 2/1939 | Kidd | 368/27 |
| 2,169,956 | A * | 8/1939 | Leatart | 368/27 |
| 2003/0156497 | A1 | 8/2003 | Peynado | |
| 2010/0124152 | A1 * | 5/2010 | Lee | 368/232 |

FOREIGN PATENT DOCUMENTS

WO 2008 125535 10/2008

OTHER PUBLICATIONS

International Search Report Issued Sep. 11, 2012 in PCT/EP12/54590 Filed Mar. 15, 2012.

* cited by examiner

*Primary Examiner* — Sean Kayes
(74) *Attorney, Agent, or Firm* — Oblon, McClelland, Maier & Neustadt, L.L.P.

(57) ABSTRACT

A universal timepiece includes a manual mechanism to shift selectively some of geographical labels borne by a dial by 1/24th of a revolution, to make it possible to change, by one hour, local times associated with the geographical labels during a change from wintertime to summertime or from summertime to wintertime.

6 Claims, 5 Drawing Sheets

UNIVERSAL TIMEPIECE

CROSS-REFERENCE TO RELATED APPLICATIONS

This is a National Phase Application in the United States of International Patent Application PCT/EP 2012/054590 filed Mar. 15, 2012, which claims priority on European Patent Application No. 11158321.7 of Mar. 15, 2011. The entire disclosures of the above patent applications are hereby incorporated by reference.

FIELD OF THE INVENTION

The present invention relates to a timepiece, termed universal, the dial of which makes it possible to read rapidly the time at various time zones. More particularly, it relates to such a timepiece comprising a first dial bearing geographical labels which correspond to various time zones and which define a circuit of 24 hours, and comprising a second dial bearing a 24 hour hour-circle, the second dial being moveable concentrically to the first dial and being provided in order to be driven in rotation at a pace of one revolution every 24 hours by the movement of the timepiece, the time indications being arranged opposite the geographical labels of the first dial in order to indicate local times.

PRIOR ART

Universal timepieces which correspond to the above definition are known. Swiss patent CH 270,085 in particular describes a universal watch which comprises a central fixed twelve-hour dial above which, in a conventional manner, hour, minute and second hands turn. A first twenty-four hour annular dial is mounted rotatably about the central dial. This annular dial is provided in order to be driven by the movement, in the opposite direction to the hands of the watch, at the speed of one revolution every twenty-four hours. It is also synchronised with the hands so that the 12 and 24 hour indications go by the "twelve o'clock" position of the watch at the exact moment when the hands are superposed at twelve o'clock. A second annular dial bearing geographical labels which correspond to the time zones is mounted rotatably about the first annular dial. It is provided in order to be displaced manually by means of a control crown, the stem of which ends with a conical pinion which engages with a peripheral toothing of the second annular dial.

In order to find out the time at a given place, the user of this prior art watch must use the crown in order to turn the second annular dial and to bring the label corresponding to the location where the user is to the "twelve o'clock" position of the watch. The two dials then make it possible to read the time corresponding to each of the time zones of the globe. Thus, as illustrated in this prior document, when it is eight p.m. in New York, it is one a.m. in Paris, ten a.m. in Tokyo and six p.m. in Mexico.

An acknowledged problem with this type of universal watch concerns the change from winter time to summer time and vice versa. In fact, because of this biannual time change, the time difference between two places is not always constant. On the contrary, when the hour change does not take place at the same time in the two places under consideration, the seasonal time change is accompanied by variations in the time difference. This is usually the case in particular when the two places are located, one in the northern hemisphere, and the other in the southern hemisphere. Furthermore, this is of course always the case when the country where one of the places is located does not have daylight saving time whilst the country of the other place does have it.

Because of the above-mentioned problem, the indications provided by most known universal watches are only exact in certain standard situations and are wrong in a certain number of atypical situations.

SUMMARY OF THE INVENTION

One aim of the present invention is to remedy problems associated with the above-mentioned prior art. The present invention achieves this aim by providing a universal timepiece according to the annexed claim 1.

BRIEF DESCRIPTION OF THE DRAWINGS

Other features and advantages of the present invention will appear upon reading the description which will follow, given solely by way of non-limiting example, and with reference to the annexed drawings in which.

DETAILED DESCRIPTION OF THE INVENTION

Figure 1:
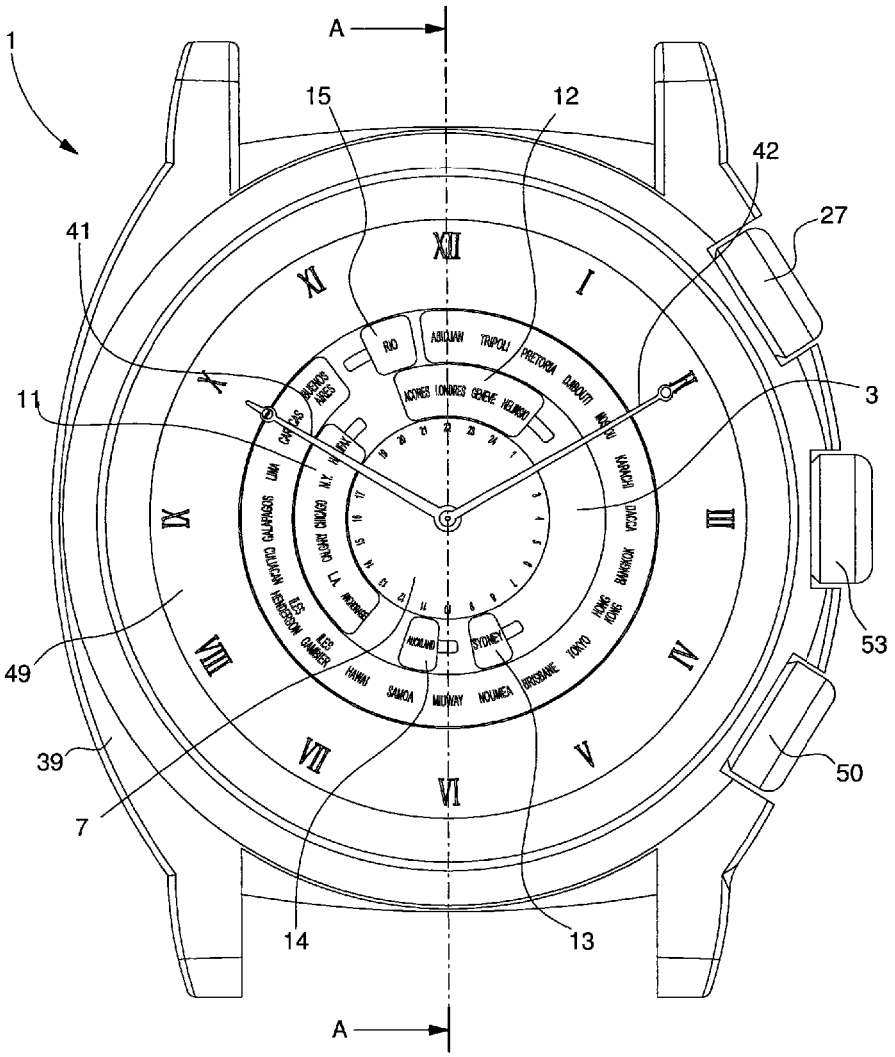
FIG. 1 is a plan view from the dial side of a universal watch according to a particular embodiment of the invention.
Figure 8:
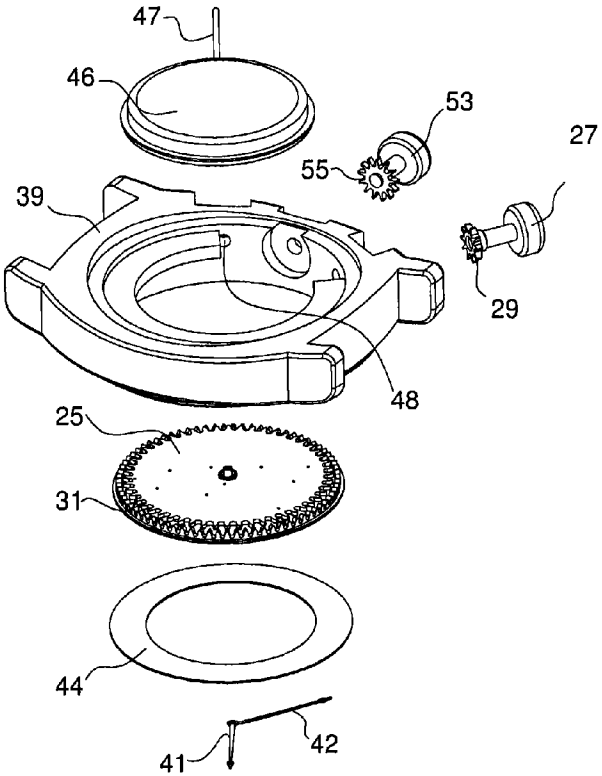
FIGS. 7 and 8 are two schematic exploded views showing the main elements of the watch of FIG. 1.
Figure 7:
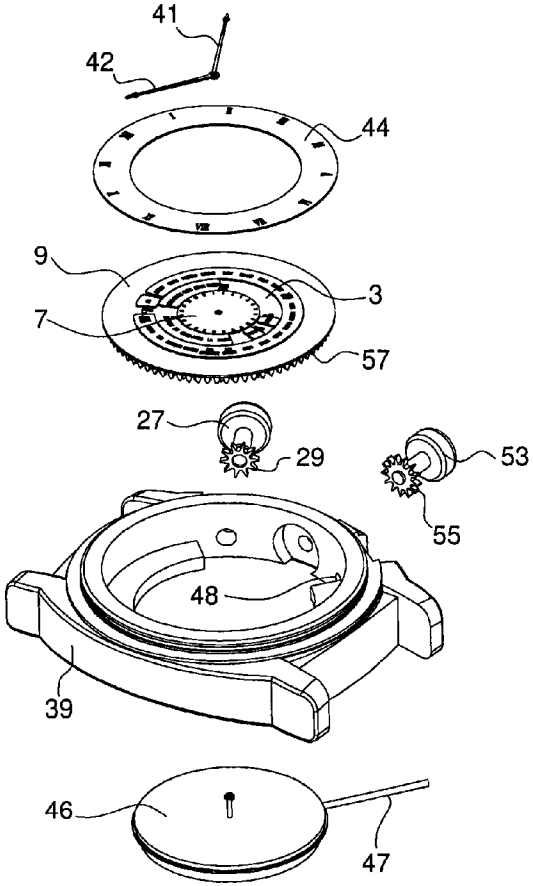

FIG. 1 is a plan view from the dial side of a universal watch according to the invention. FIGS. 7 and 8 are two schematic exploded views showing the main elements of this same watch. With reference simultaneously to FIGS. 1, 7 and 8, it can be seen that the represented watch comprises a middle 39 which is closed over the top by three dials. First of all there can be seen a fixed annular dial 44 which bears a 12-hour hour-circle, and which is provided in order to cooperate with hour and minute hands referenced 41 and 42 respectively. The annular dial 44 surrounds a first dial 3 which is formed by a dial support (or plate) 9 which in the present case has the shape of a disc and which bears moveable dial sectors (11 to 15) of the dial. The first dial 3 is provided with geographical labels 5 which go around the dial and correspond to the 24 time zones of the planet. Furthermore, the first dial bears a second central dial (reference number 7) which is disposed concentrically to the first dial. The second dial bears a 24-hour hour-circle which is provided in order to cooperate with the geographical labels of the first dial in order to indicate local times. The second dial 7 is provided in order to be driven in rotation by the movement 46 of the watch in the opposite direction to the hands. It should be understood that, according to other embodiments, the second dial could just as well turn in the same direction as the hands. In this case, the order of succession of the times on the hour-circle of the dial 7 would likewise be reversed. The first dial 3 is provided in order to be controlled manually in rotation by a manual control member which can be activated from outside the middle. This control member comprises a crown 53 which is integral with a pinion 55. The pinion 55 is provided in order to engage with a peripheral edgewise toothing 57 of the support 9. It will be understood that this arrangement makes it possible for the wearer of the watch to turn the first dial 3, and therefore the geographical labels 5 which it bears, by activating the ring 53.

Figure 3:
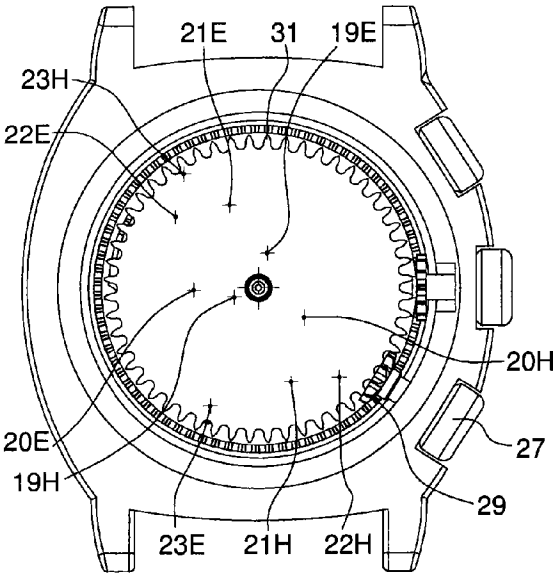
FIG. 3 is a plan view from the back side of the watch of FIG. 1, the watch being partially disassembled in order to make the programming disc visible.

FIG. 8 also shows a programming disc 25 which is mounted under the support 9 of the first dial 3, coaxially with the latter. As will be seen in more detail further on, the programming disc 25 is part of the manual means which, according to the invention, are provided in order to shift selectively some of said geographical labels by $1/24^{th}$ of a revolution. For this purpose, the watch of the illustrated example comprises a dedicated control member in the form of a rotatable crown 27 which is mounted at four o'clock on the middle of the watch. With reference likewise to FIG. 3, it can be seen that the crown 27 is integral with a pinion 29 which is disposed inside the watch case. The pinion 29 engages with a peripheral toothing 31 of the programming disc 25. A spring-catch 51 (FIG. 6) is furthermore provided in order to make the programming disc and the first dial 3 interlock. Specifically, the catch 51 must not be too strong so that when the crown 27 is activated, the disc 25 is able to turn without driving the dial 3 therewith.

The middle 39 is further provided to receive the movement 46 of the watch. In a standard manner, the movement of the watch comprises cannon-pinion and concentric hour-wheel (not shown) which bear the minute and hour hands 42, 41 respectively. The movement 46 also comprises a 24-hour-wheel concentric to the axis of the hands and which is provided in order to drive the second dial 7 at a speed of one revolution every 24 hours. An opening 48 is also provided in the middle 39 in order to allow passage of the winding and setting stem 47 of the movement. This stem ends with a knurled crown 50 (FIG. 1).

Figure 2:
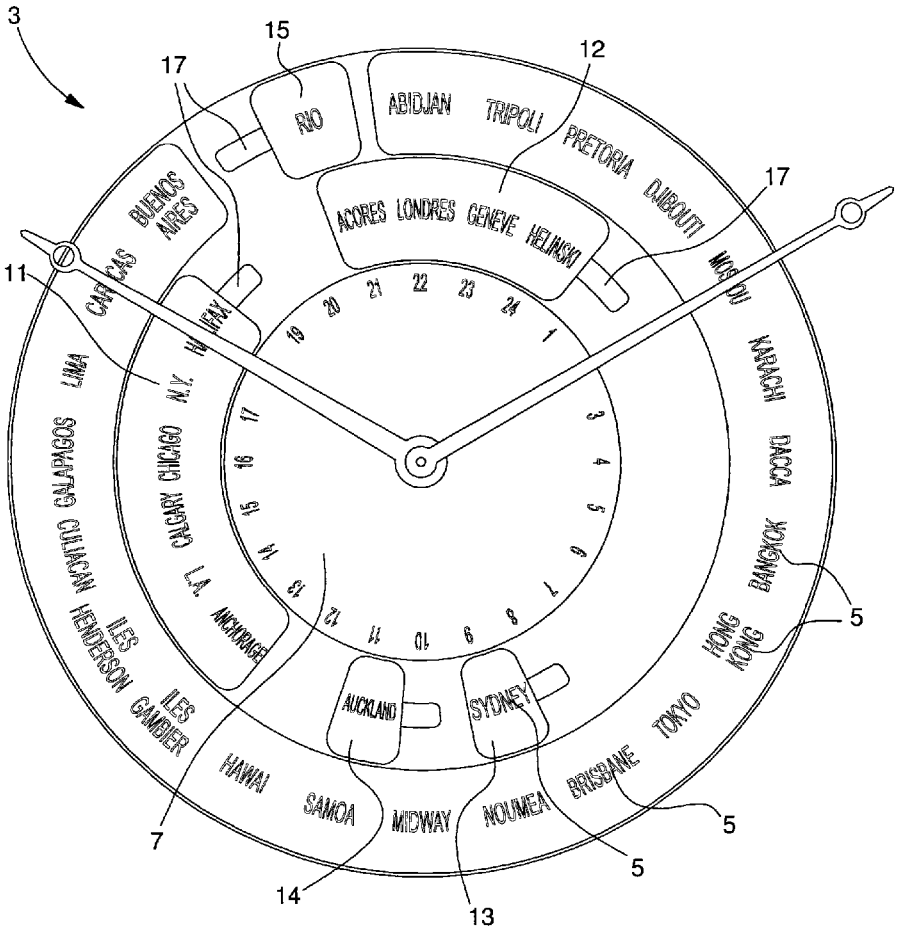
FIG. 2 is an enlarged view of a part of FIG. 1, showing in particular the first and the second dial.

FIG. 2 is an enlarged view of a part of FIG. 1, showing in particular the first and the second dial (referenced 3 and 7 respectively). In this enlarged view, it can be seen that the moveable dial sectors 11, 12, 13, 14 and 15 bear some of the geographical labels 5, whilst other geographical labels are set directly on the plate 9 of the dial. Furthermore, the plate 9 is pierced by a certain number of oblong openings 17 (more clearly visible in FIG. 5) which define arcs that are concentric with the dial. As will be seen in more detail further on, the various sectors 11 to 15 are each provided to slide in one of the oblong openings in order to allow them to be shifted angularly by $1/24^{th}$ of a revolution relative to the plate of the first dial 3.

Geographical labels 5 borne by the same moveable dial sector correspond to different geographical locations where the time-change from summer to wintertime, as well as from winter to summertime take place on the same date. For example, it can be seen in FIG. 2 that the dial sector with the reference number 12 bears, from left to right, the geographical labels "Azores", "London", "Geneva" and "Helsinki". It can be verified that the hour change indeed takes place on the same date in these four places. In fact, it has been decided that, for the time being, the change to summertime would take place on the last Sunday of March, and the return to wintertime would take place on the last Sunday of October in this part of the globe. It can be seen also in FIG. 2 that the dial sector with the reference number 11 bears, from left to right, the geographical signs "Anchorage", "L.A.", "Calgary", "Chicago", "N.Y." and "Halifax". These six towns are all located in the United States or in Canada and, in these regions, the change to summertime currently takes place on the second Sunday of March, whilst the return to wintertime takes place on the first Sunday of November.

In the illustrated embodiment, three other sliding sectors (referenced 13, 14 and 15 respectively) each bear a single geographical label. Each of these three geographical labels corresponds to a place in the southern hemisphere where, as is well known, the seasons are reversed relative to the northern hemisphere. For example, in Sydney (dial sector 13) and in the south of Australia, the change to summertime takes place on the first Sunday of October, and the return to wintertime takes place on the first Sunday of April of the following year. In Auckland (dial sector 14) and in the rest of New Zealand, the change to summertime takes place on the first Sunday of September and the return to wintertime takes place on the first Sunday of April of the following year. Finally, in Rio de Janeiro (dial sector 15), the change to summertime takes place on the third Sunday of October and the return to wintertime takes place on either the third or the fourth Sunday of February of the following year.

It can be seen in FIG. 2 that the first annular dial 3 also bears, from left to right, the geographical labels "Abidjan", "Tripoli", "Pretoria", "Djibouti", "Moscow", "Karachi", "Dacca", "Bangkok", "Hong Kong", "Tokyo", "Brisbane", "Noumea", "Midway", "Samoa", "Hawaï", "Gambier Islands", "Henderson Islands", "Culiacan", "Galapagos", "Lima", "Caracas" and "Buenos Aires". These last geographical labels correspond to places where daylight saving time doesn't exist. As no seasonal time change takes place in these locations, the corresponding geographical labels have no need to be borne by the moveable dial sectors and therefore can be borne directly by plate 9 of the first dial.

Figure 5:
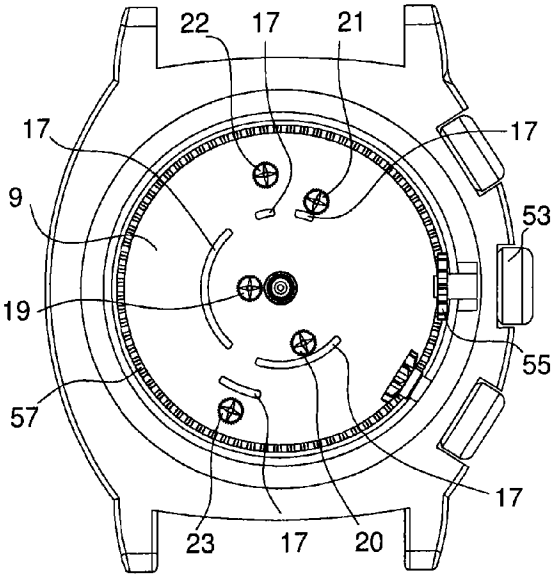
FIG. 5 is a view similar to that of FIG. 3, the programming disc, the toothed sectors and the catches being likewise removed in order to make the support of the first dial visible.
Figure 4:
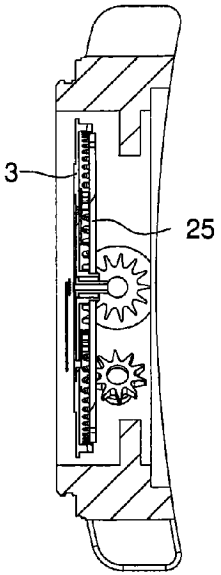
FIG. 4 is a sectional view according to A-A of FIG. 1.

FIG. 5 is a view from the back side of the watch, the back-plate and the movement having been removed so as to show the plate 9 of the dial 3 from below. As already mentioned in relation to FIGS. 1 and 2, the plate 9 is pierced by a certain number of oblong openings 17 which define arcs of circles concentric to the dial. In the present example, these various arcs do not all belong to the same circle. Four of them belong to a first circle, whilst the fifth is on a circle of a greater diameter. It can be seen again in FIG. 5 that the plate 9 likewise bears five small moveable star-shaped parts (respectively with the reference numbers 19, 20, 21, 22 and 23), each formed by a four-armed star-wheel and a small gear assembled in a coaxial position. The five small moveable star-shaped parts are mounted rotatably on the plate 9 and, as FIG. 5 shows, the distances separating them from the axis of the watch are all different in the present example.

Figure 6:
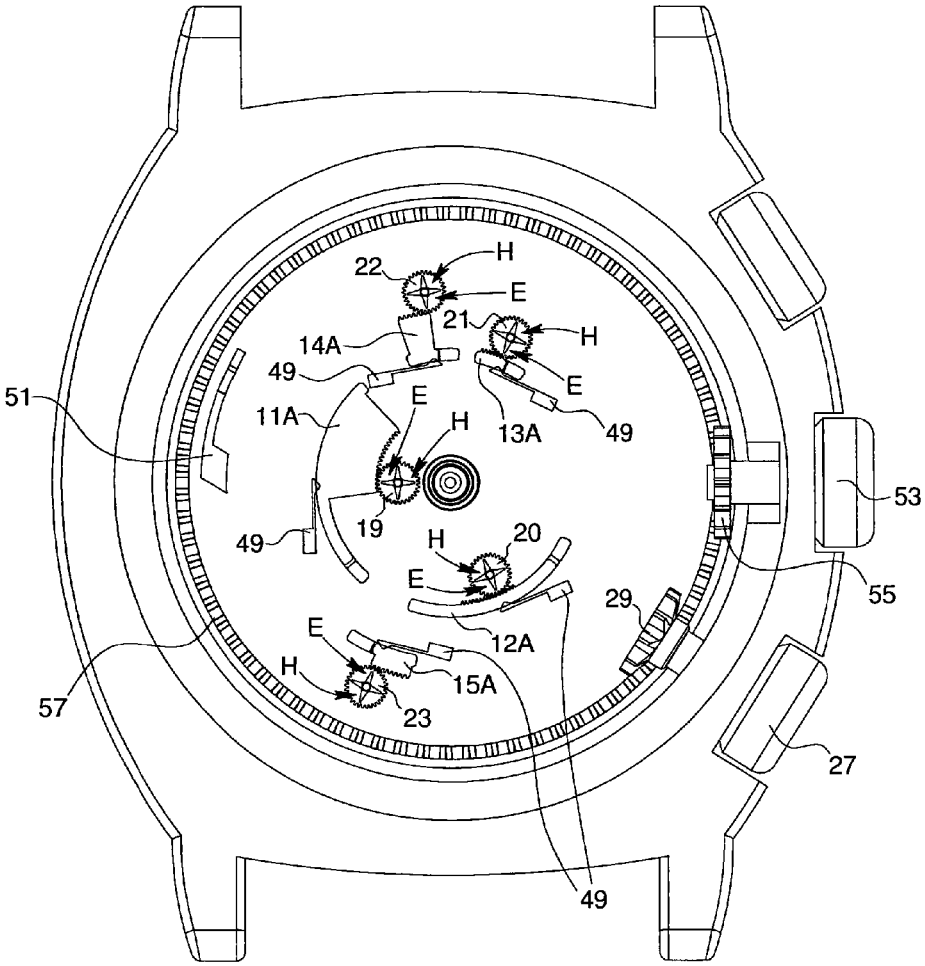
FIG. 6 is a view similar to that of FIG. 5, likewise showing toothed sectors and the catches.

As stated further back, the moveable dial sectors 11, 12, 13, 14 and 15 are provided in order to slide in the oblong openings 17. For this purpose, the moveable dial sectors comprise legs (not represented) which are inserted in the oblong openings such that the end of a leg emerges under the plate of the first dial. FIG. 6 is a view similar to FIG. 5, showing furthermore five toothed sectors (referenced 11A, 12A, 13A, 14A and 15A respectively). On the base of FIG. 6, it is clear that the moveable dial sectors are each integral with one of the toothed sectors by means of legs which pass through the oblong openings 17 (when assembling the timepiece, it is possible for example to proceed by firstly inserting the legs into the oblong openings of the plate and then driving the distal end of each leg into a hole provided for this purpose in one of the toothed sectors). As can also be seen in FIG. 6, each of the toothed sectors 11A, 12A, 13A, 14A and 15A engages with the toothing of one of the small moveable star-shaped parts (respectively 19, 20, 21, 22 and 23). Thus a rotation of one of the small moveable star-shaped parts will have the effect of causing the corresponding dial sector to slide inside one of the oblong openings of the plate of the first dial. Finally, Finally, FIG. 6 shows five spring-catches 49 which are provided in order to cooperate with the five moveable dial sectors. It is clear that, on the one hand, thanks to the limited length of the oblong openings 17 and, on the other hand, to the presence of the catches 49, the moveable dial sectors 11 to 18 can each occupy only two stable positions which are separated from each other by $1/24^{th}$ of a revolution.

FIG. 3 is a similar view to those of FIGS. 5 and 6 but in which a programming disc 25 is further shown, the function of which is to determine the order in which the various moveable dial sectors 11, 12, 13, 14 and 15 are activated. In this view from the back-side of the watch, the programming disc almost entirely masks the plate 9 of the first dial, except for the peripheral toothing 57, which is visible. It will become clear moreover that the toothed sectors 11A, 12A, 13A, 14A and 15A and the small moveable star-shaped parts 19, 20, 21, 22 and 23 which are arranged between the programming disc 25 and the plate 9 are no longer visible in FIG. 3. However, it can be seen that the programming disc is provided with ten pins with the reference numbers 19H, 19E, 20H, 20E, 21E, 21H, 22E, 22H, 23E and 23H. Actually the pins are turned towards the plate 9 and are arranged on the face of the programming disc that is not visible in FIG. 3. However, in the present example, the pins are driven into small holes in the programming disc. It is in fact the small holes into which the pins are driven which are visible in FIG. 3.

It can be seen in FIG. 3 that the crown 27 is integral with a pinion 29 which is disposed inside the watch case. The pinion 29 engages with a peripheral toothing 31 of the programming disc 25. In the present example, the programming disc is arranged to turn in the same direction as the hands of the watch when it is activated. Means known to the person skilled in the art (not represented) are preferably also provided in order to prevent rotation of the programming disc in the opposite direction to the hands of the watch. However, it will become clear that the invention is not limited to the case where the programming disc must be activated in the direction of the hands of the watch. On the contrary, according to other embodiments, the programming disc could be provided in order to turn in the opposite direction to the hands of the watch when it is activated. In this case, the pins would be disposed in a different configuration on the disc.

As can be seen in FIG. 3, in the illustrated example, the respective distances separating the ten pins from the axis of the watch are all different. Furthermore, these distances become greater in the order of the pins 19H, 19E, 20H, 20E, 21E, 21H, 22E, 22H, 23E and, finally, 23H. When the wearer of the watch turns the programming disc 25 by activating the control member 27, each of the pins borne by the disc are displaced according to a circular trajectory, the radius of which is equal to the distance separating this pin from the axis of the hands of the watch. It was noted already further back that the distances separating the five moveable star-shaped parts from the axis of the watch were likewise all different. In fact, each moveable star-shaped part is disposed such that its star-wheel intercepts the trajectory of exactly two pins. Thus, the moveable star-shaped part 19 is disposed in order to intercept the circular trajectories of the pins 19H and 19E, the moveable star-shaped part 20 is disposed in order to intercept the trajectories of the pins 20H and 20E and so on.

The pin 19H is situated slightly nearer the axis of the hands of the watch than is the axis of the moveable star-shaped part 19. Thus, it will become clear that when the pin 19H turns and encounters the star of the moving part 19, it makes it turn by a quarter of a revolution in the opposite direction to the direction of rotation of the programming disc. Conversely, the pin 19E is situated slightly further away from the axis of the hands of the watch than is the moveable star 19. Thus, when the pin 19E encounters the star of the moveable part 19, it makes it turn in the same direction as the programming disc. Furthermore, as can also be seen in FIG. 2, the toothing of the toothed sector 11A is an internal toothing (in other words, turned in the direction of the axis of the hands). Under these conditions, it will become clear that, when the moveable star-shaped part 19 drives the toothed sector 11A, the latter turns in the same direction as the moveable star-shaped part. Under these conditions, when the pin 19E encounters the star of the moveable part 19 and when the latter effects consequently a rotation by a quarter of a revolution in the direction of the hands of the watch, the result of this rotation is to make the moveable dial sector 11 slide in the direction of the hands of the watch also. This amounts to saying that the pin 19E makes the moveable dial sector 11 move to summertime. With respect to the pin 19H the reverse is the case. In fact, as has been seen, the pin 19H makes the moveable star-shaped part 19 turn in the reverse direction. Thus, it will be understood that the pin 19H is provided in order to make the moveable dial sector 11 return to wintertime when it encounters the moveable star-shaped part.

With reference once again to FIGS. 3 and 5, it can further be seen that the pins are disposed on the programming disc 25 such that each encounter of one of the pins with a moveable star-shaped part corresponds to a different angular position of the programming disc. Furthermore, the relation between the position of the pins and that of the moveable star-shaped part is such that the pins operate in the order 23H, 19E, 20E, 21H, 22H, 22E, 21E, 23E, 20H and, finally, 19H, when the programming disc turns in the direction of the hands of the watch. Specifically, the manual means which have just been described make it possible to control correctly the changes back and forth between wintertime and summertime even if the dates of these changes vary from one year to another, just because the succession of the time changes in the various indicated places on the watch always keeps the same order. However, it is clear that, if a political decision were to alter this order of succession of the time changes, it would suffice to change the programming wheel 25 in order to adapt the watch to the new situation.

The invention claimed is:

1. A universal timepiece comprising:

a first dial bearing geographical labels which correspond to different time zones and which define a circuit of 24 hours;

a second dial bearing a 24 hour hour-circle which is concentric to the first dial and configured to be driven in rotation by the movement of the timepiece, the second dial bearing time markings arranged opposite geographical labels of the first dial to indicate local times; and manual means to shift selectively some of the geographical labels by $1/24^{th}$ of a revolution, to make it possible to change, by one hour, local times associated with the geographical labels during a change from wintertime to summertime or from summertime to wintertime.

2. An universal timepiece comprising:

a first dial bearing geographical labels which correspond to various time zones and which define a circuit of 24 hours, a second dial bearing a 24 hour hour-circle which is concentric to the first dial and arranged to be driven in rotation by the movement of the timepiece, the second dial bearing time markings arranged opposite geographical labels of the first dial in order to indicate local times; and a manual control member configured to be activated from the outside of the timepiece to shift selectively some of said geographical labels by 1/24th of a revolution, and to enable a change, by one hour, of the local times associated with the geographical labels during a change from wintertime to summertime or from summertime to wintertime.

3. The universal timepiece of claim 2, further comprising moveable dial sectors borne by the first dial and configured to be controlled by the control member to be shifted angularly by 1/24th of a revolution relative to the first dial, and wherein the moveable dial sectors bear said geographical labels which correspond to places where daylight saving time is implemented.

4. The universal timepiece of claim 3, wherein at least one of said moveable dial sectors bears several geographical labels which correspond to different time zones, the geographical labels borne by the same moveable dial sector designating places where the changes between summertime and wintertime, as well as between wintertime and summertime are on the same dates.

5. The universal timepiece of claim 3, further comprising:

a plurality of stars fixed rotatably to the first dial, each of said stars being connected kinematically to one of the moveable dial sectors, and a programming disc configured to be activated in rotation by the control member, the programming disc bearing a plurality of pins configured each to cooperate with one of the stars to make said one of the stars turn when the programming disc is activated in rotation.

6. The universal timepiece of claim 5, wherein each of said stars is associated with two of said pins, one of the two pins being configured to make the star turn in one direction, and the other of the two pins being configured to make the star turn in the reverse direction.

* * * * *